United States Patent [19]

Jenkins

[11] 4,425,135

[45] Jan. 10, 1984

[54] MOTOR FUEL CONTAINING REFINED CARBONACEOUS MATERIAL

[76] Inventor: Rodman Jenkins, SUPRI, Stanford, Calif. 94305

[21] Appl. No.: 166,349

[22] Filed: Jul. 7, 1980

[51] Int. Cl.[3] ..... C10L 1/32

[52] U.S. Cl. ..... 44/51; 44/1 R; 208/8 LE

[58] Field of Search ..... 44/51, 1 R; 208/8 LE

[56] References Cited

U.S. PATENT DOCUMENTS

| | | | |
|---|---|---|---|
| 1,681,335 | 8/1928 | Griessbach et al. | 44/51 |
| 1,699,355 | 1/1929 | Hammond | 44/56 |
| 1,752,724 | 4/1930 | Bourie | 44/56 |
| 4,030,893 | 6/1977 | Keller | 44/1 B |
| 4,043,763 | 8/1977 | Norman et al. | 44/1 R |
| 4,052,169 | 10/1977 | Cole et al. | 44/1 R |
| 4,059,411 | 11/1977 | Smith | 44/51 |
| 4,128,401 | 12/1978 | Powell et al. | 44/1 B |
| 4,146,366 | 3/1979 | Keller | 44/1 R |
| 4,192,651 | 3/1980 | Keller | 44/1 R |

*Primary Examiner*—Charles F. Warren
*Assistant Examiner*—Y. Harris-Smith
*Attorney, Agent, or Firm*—James J. Brown

[57] ABSTRACT

A stable motor fuel is disclosed which contains essentially ash free refined carbonaceous material having a specific particle size range. The refined carbonaceous material can be obtained by treating coal, and is mixed either with a low molecular weight alcohol alone or a combination of low molecular weight alcohol and liquid hydrocarbon fuel such as gasoline or diesel fuel.

30 Claims, No Drawings

MOTOR FUEL CONTAINING REFINED CARBONACEOUS MATERIAL

SUMMARY OF THE INVENTION

The invention is directed to refined carbonaceous material of specific particle size and reduced ash content, which can be combined with low molecular weight alcohol alone or low molecular weight alcohol and liquid hydrocarbon fuel, such as diesel fuel or gasoline, to provide a fuel composition suitable for use in liquid hydrocarbon fueled motors.

CROSS-REFERENCE TO RELATED APPLICATIONS

Co-pending application Ser. No. 128,127, filed Mar. 7, 1980 now U.S. Pat. No. 4,319,980 is incorporated herein by reference.

BACKGROUND OF THE INVENTION

Investigations of the possible direct use of powdered coal as a motor fuel have been conducted for many years without commercial success. The principal problems have been abrasion due to the ash content of the coal and incomplete combustion due to the low burning rate of the coal particles.

Extraction of coal by various solvents has been studied even more intensively for several decades, but the possibility of using these coal extracts directly as motor fuel has not resulted in a commercial product.

The advantages of using coal extract directly as a motor fuel are great, however, since there is high cost and much loss of useful energy in conversion of coal into gasoline and diesel fuel.

Possible reasons for past lack of interest in the possibilities of such use are:

1. Low burning rate of product from high severity hydrogen donor solvent processes such as Solvent Refined Coal and Pott-Broche processes;
2. High residual ash content of extract from alkali extraction processes;
3. Agglomeration of colloidal size coal particles in hydrocarbon fuels.

High severity processes remove a majority of the oxygen from the coal, and therefore greatly reduce the burning rate of particles of a given size. In addition, product from the Pott-Broche or Solvent Refined Coal processes is obtained as a molten solid, which forms large lumps as it solidfies. Grinding it to a micron-range particle size that might have suitable burning characteristics is expensive.

Examples of high severity extraction processes are: Pott-Broche, Solvent Refined Coal, and processes extracting with alkali in low molecular weight alcohols ($C_1$–$C_4$) at temperatures of 300° C. or above.

To be suitable for use in a motor fuel, four factors are important with respect to the use of coal;

1. Ash content
2. Combustion characteristics
3. Fuel system tolerances
4. Stability of fuel suspension.

It has already been noted that ash present in coal can be a serious problem in motors due to its abrasive characteristics. The three remaining factors all relate, at least in part to the particle size of the coal. For example, although burning rate is related to chemical composition of the coal, available data indicate that particles smaller than 30 microns from bituminous coal will burn satisfactorily in diesel engines, and particles from subbituminous coals or lignite smaller than 30 microns should burn satisfactorily in either diesel or spark ignited engines.

While smaller particle size is desirable from the standpoint of combustion and suspension stability, too small particle size is undesirable from the standpoint of fuel viscosity. This is particularly true of particles smaller in diameter than one micron.

Further, most current gasoline and diesel engine have fuel filters designed specifically to remove suspended particles. A typical commercial diesel engine has a filter with 20 micron pore openings; and therefore will not pass many particles above about 10 microns in size. Filters with slightly larger openings can easily be substituted, but a major increase in filter pore opening is undesirable and may be impossible because the filter would then pass dirt and other abrasive particles picked up by the fuel in storage and shipment.

Accordingly, it is an object of the present invention to provide a liquid motor fuel incorporating refined, particulate carbonaceous material, the carbonaceous material being characterized by forming a relatively stable suspension and having good burning characteristics, without being harmful to the motor.

DETAILED DESCRIPTION OF THE INVENTION

These and other objects are achieved according to the present invention which is directed to a refined carbonaceous material of specific particle size range and reduced ash content, and which can be combined with appropriate liquid fuel material for use as a motor fuel.

The carbonaceous material of the present invention is advantageously obtained by the procedures disclosed in my co-pending application Ser. No. 128,127, filed Mar. 7, 1980 now U.S. Pat. No. 4,319,980 and entitled "Method For Treating Coal to Obtain a Refined Carbonaceous Material", the subject matter of which is incorporated herein by reference. The disclosed procedures essentially comprise treating coal with an amine solution to dissolve a portion of the coal leaving undissolved coal and waste material such as ash. The dissolved coal is then separated from the undissolved components and the amine solution removed to leave the refined carbonaceous extract of the invention.

In contrast with some other extraction processes such as Pott-Broche, Solvent Refined Coal, and extractions with alcoholic alkaline solutions above 300° C., the disclosed amine extraction procedure of the copending application does not result in a high degree of oxygen removal from the coal, which is desirable, since decreased oxygen content results in reduced burning rate. Extracts obtained, however, using ethylene diamine or aqueous solutions of alkali metal hydroxides or carbonates at temperatures not exceeding 200° C. as solvents have essentially the same elemental analysis, but ash free, as the original coal.

The carbonaceous material of this invention, in addition to being substantially ash free, has a predominant particle size range of 2–10 microns, with at least 80 percent by weight and preferably 95 percent comprising particles in this range. Preferably no more than 1 percent by weight of the refined material has a particle size of less than 1 micron and no more than 1 percent by weight has a particle size above 20 microns.

The level of ash in the carbonaceous material of the invention is also reduced well below that ordinarily found in coal to a level of less than 0.5 percent by weight and preferably less than 0.2 percent by weight. Less than 0.1 percent by weight of the refined material is ash having a particle size over 2 microns.

The refined, substantially ash free carbonaceous material of the present invention is most advantageously employed in combination with low molecular weight alcohols, either alone or with other liquid hydro-carbon fuels, as a fuel composition which is particularly suitable for use in motors of the type conventionally powered by diesel fuel or gasoline. The term "diesel fuel" is used herein to represent conventional petroleum derived diesel fuel. Particularly advantageous is the use of the fuel composition of this invention in non-carbureted internal combustion engines, such as diesel or fuel injected engines.

The preferred low molecular weight alcohols are those of 1 to 4 carbons with methanol or ethanol being most preferred. In addition, however, to being used in combination with both alcohol and liquid hydrocarbon fuel such as gasoline or diesel oil, the refined carbonaceous fuel of the invention can also be advantaegously used alone in combination with low molecular weight alcohols such as methanol or ethanol.

When the ash free carbonaceous material of the invention is to be blended with liquid hydrocarbon fuels such as gasoline or diesel fuel, advantageously, the carbonaceous material is first mixed with the appropriate amount of the low molecular weight alcohol component of the fuel composition. Such mixing can be carried out using a colloid mill, for example, or other means that will assure dispersal of any agglomerated material into the desired suspension. The pre-mixing of the alcohol and carbonaceous material components is desirable since it is theorized that hydrogen bonding between the particles of carbonaceous material and hydroxyl groups in the alcohol peptizes the particles, thereby aiding in formation of a stable suspension.

Up to 30 weight percent, based on the total composition, of the refined carbonaceous material of the present invention can be incorporated into low molecular weight alcohol to form a fuel composition useful in internal combustion engines. A more preferred amount of carbonaceous material is 5 to 30 weight percent based on the total composition with 10 to 30 weight percent being most preferred.

Similar quantities of the refined carbonaceous material of the invention can also be combined with liquid hydrocarbon fuels such as gasoline or diesel fuel to provide a fuel composition suitable for use in internal combustion engines. It is a further feature of the invention that the incorporation of the carbonaceous material into the hydrocarbon fuel also permits a higher proportion of low molecular weight alcohol to be used in the fuel. Thus, fuel compositions of the present invention, in addition to containing up to 30 weight percent, preferably 5 to 30 weight percent and most preferably 10 to 30 weight percent carbonaceous material also contain up to 20 weight percent, preferably 5 to 20 weight percent alcohol and at least 65 weight percent, preferably 90 to 65 weight percent hydrocarbon fuel such as gasoline or diesel fuel.

Besides providing a practical motor fuel having a reduced hydrocarbon component, and permitting inclusion in the fuel of larger proportions of alcohol, the present invention also permits engine knock to be reduced by selection of the refined carbonaceous material. Since knock is caused by too rapid combustion propagated by free radicals, the addition of slower burning solids which adsorb these free radicals has a substantial anti-knock effect. Thus, the burning rate of the carbonaceous component and therefore the fuel composition containing it can be controlled by blending components obtained from different sources to obtain the desired anti-knock properties without leaving residual unburned material. For example inclusion of refined, carbonaceous material obtained from bituminous or antracite coal results in a fuel which burns more slowly than that obtained from lignite or sub-bituminous coal.

The following examples are illustrative of the present invention. The refined coal extract referred to in each example is obtained by the amine extraction procedures described in my co-pending application Ser. No. 128,127. This extract would be milled with liquid fuel to produce suspended particles having 95 weight percent 2–10 microns, with 1 weight percent above 20 microns and less than 1 weight pervent below 1 micron. Ash content would be less than 0.075 weight percent.

EXAMPLE 1—GASOLINE BASED FUEL

| Component | Weight % |
|---|---|
| Refined Coal | 15 |
| Methanol | 15 |
| Gasoline | 70 |

EXAMPLE 1—HYDRATED ALCOHOL BASED FUEL

| Component | Weight % |
|---|---|
| Refined Coal | 15 |
| Ethanol | 80 |
| Water | 5 |

EXAMPLE 3—DIESEL FUEL BASED FUEL

| Component | Weight % |
|---|---|
| Refined Coal | 10 |
| Ethanol | 5 |
| Diesel Fuel | 85 |

I claim:

1. A fuel composition having a controlled burning rate and comprising a stable suspension of 5 to 50 weight percent refined carbonaceous material with a reduced ash content of less than 0.5% by weight ash and a predominant particle size of 2–10 microns, 5 to 20 weight percent low molecular weight alcohol, and at least 65 weight percent liquid, combustible hydrocarbon selected from the group consisting of gasoline and diesel fuel, said carbonaceous material having been obtained by solvent extraction of coal at a temperature not exceeding 200° C.

2. The composition of claim 1, wherein said refined carbonaceous material is refined coal.

3. The composition of claim 2, wherein said coal is lignite or sub-bituminous coal.

4. The composition of claim 1, wherein said alcohol has 1–4 carbon atoms.

5. The composition of claim 4, wherein said alcohol is methyl or ethyl alcohol.

6. The composition of claim 1, wherein at least 80 percent by weight of the carbonaceous material has a particle size of 2–10 microns.

7. The composition of claim 6, wherein the ash content is less than 0.2 percent by weight.

8. The composition of claim 6, wherein at least 95 percent by weight of said carbonaceous material has a particle size of 2–10 microns.

9. The composition of claim 6, wherein no more than 1 percent by weight of said carbonaceous material has a particle size below 1 micron.

10. The composition of claim 6, wherein no more than 1 percent by weight of said carbonaceous material has a particle size above 20 microns.

11. A composition having a controlled burning rate and suitable for use in motor fuels comprising refined particulate carbonaceous material having a reduced ash content of less than 0.5% by weight ash, and a predominant particle size of 2–10 microns, said carbonaceous material having been obtained by solvent extraction of coal at a temperature not exceeding 200° C. using a solvent selected from the group consisting of ethylene diamine, aqueous solutions of alkali metal hydroxides and aqueous solutions of alkali metal carbonates.

12. The composition of claim 11, wherein the ash content is less than 0.5 weight percent and at least 80 percent by weight of the carbonaceous material has a particle size of 2–10 microns.

13. The composition of claim 1 which is refined coal.

14. The composition of claim 12, wherein the ash content is less than 0.2 percent by weight.

15. The composition of claim 11, wherein at least 95 percent by weight of the carbonaceous material has a particle size of 2–10 microns.

16. The composition of claim 11, wherein no more than 1 percent by weight of the carbonaceous material has a particle size below 1 micron.

17. The composition of claim 11, wherein no more than 1 percent by weight of the carbonaceous material has a particle size above 20 microns.

18. A fuel composition having a controlled burning rate comprising 5 to 30 weight percent refined carbonaceous material having a reduced ash content of less than 0.5% by weight ash and a predominant particle size of 2–10 microns and 95 to 70 weight percent of a low molecular weight alcohol, said carbonaceous material having been obtained by solvent extraction of coal at a temperature not exceeding 200° C.

19. The composition of claim 18, wherein said refined carbonaceous material is refined coal.

20. The composition of claim 19, wherein said coal is lignite or sub-bituminous coal.

21. The composition of claim 18, wherein said alcohol has 1–4 carbon atoms.

22. The composition of claim 21, wherein said alcohol is methyl or ethyl alcohol.

23. The composition of claim 18, wherein at least 90 percent by weight of the carbonaceous material has a particle size of 2–10 microns.

24. The composition of claim 23, wherein the ash content is less than 0.2 percent by weight.

25. The composition of claim 23, wherein at least 95 percent by weight of said carbonaceous material has a particle size of 2–10 microns.

26. The composition of claim 23, wherein no more than 1 percent by weight of said carbonaceous material has a particle size below 1 micron.

27. The composition of claim 23, wherein no more than 1 percent by weight of said carbonaceous material has a particle size above 20 microns.

28. The composition of claim 1 which contain 95 to 70 percent of said alcohol.

29. A fuel composition having a controlled burning rate and comprising a stable suspension of 5 to 30 weight percent refined carbonaceous material with a reduced ash content of less than 0.5% by weight ash and a predominant particle size of 2–10 microns, 5 to 20 weight percent low molecular weight alcohol, and at least 65 weight percent liquid, combustible hydrocarbon, said carbonaceous material having been obtained by solvent extraction of coal at a temperature not exceeding 200° C. using a solvent selected from the group consisting of ethylene diamine, aqueous solutions of alkali metal hydroxides and aqueous solutions of alkali metal carbonates.

30. A fuel composition having a controlled burning rate comprising 5 to 30 weight percent refined carbonaceous material having a reduced ash content of less than 0.5% by weight ash and a predominant particle size of 2–10 microns and at least 70 weight percent of a low molecular weight alcohol, said carbonaceous material having been obtained by solvent extraction of coal at a temperature not exceeding 200° C. using a solvent selected from the group consisting of ethylene diamine, aqueous solutions of alkali metal hydroxides and aqueous solutions of alkali metal carbonates.

* * * * *